US012480385B2

(12) United States Patent
Alali et al.

(10) Patent No.: US 12,480,385 B2
(45) Date of Patent: Nov. 25, 2025

(54) METHOD FOR DOWNHOLE CHEMICAL STORAGE FOR WELL MITIGATION AND RESERVOIR TREATMENTS

(71) Applicant: SAUDI ARABIAN OIL COMPANY, Dhahran (SA)

(72) Inventors: Eyad Ali Alali, Dammam (SA); Mohammed Abdullah Bataweel, Dhahran (SA); Rajendra Arunkumar Kalgaonkar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 149 days.

(21) Appl. No.: 17/930,586

(22) Filed: Sep. 8, 2022

(65) Prior Publication Data

US 2024/0084676 A1 Mar. 14, 2024

(51) Int. Cl.

| | |
|---|---|
| ***E21B 17/00*** | (2006.01) |
| ***E21B 43/01*** | (2006.01) |
| ***E21B 44/00*** | (2006.01) |

(52) U.S. Cl.

CPC ..... *E21B 43/01* (2013.01); *E21B 44/00* (2013.01)

(58) Field of Classification Search

CPC ..... E21B 41/02; E21B 43/305; E21B 43/162; E21B 43/14; E21B 43/10; E21B 47/14; E21B 7/061; E21B 37/06; E21B 43/40; E21B 43/12; E21B 43/128; E21B 43/38; E21B 43/385; E21B 43/122; E21B 43/168; E21B 17/18; B04B 5/12; B04B 1/08; C09K 8/58

See application file for complete search history.

(56) References Cited

U.S. PATENT DOCUMENTS

| | | | | |
|---|---|---|---|---|
| 4,044,830 | A * | 8/1977 | Van Huisen | F24T 10/20 165/45 |
| 5,435,400 | A | 7/1995 | Smith | |
| 5,458,197 | A * | 10/1995 | Chan | E21B 37/00 507/216 |
| 5,721,538 | A * | 2/1998 | Tubel | E21B 47/017 340/854.3 |
| 5,762,149 | A | 6/1998 | Donovan et al. | |
| 5,868,210 | A * | 2/1999 | Johnson | E21B 41/02 166/50 |
| 5,960,883 | A | 10/1999 | Tubel et al. | |
| 6,119,780 | A * | 9/2000 | Christmas | E21B 43/128 166/66.4 |
| 6,279,651 | B1 * | 8/2001 | Schwendemann | E21B 41/0035 166/54.1 |

(Continued)

OTHER PUBLICATIONS

Office Action issued in U.S. Appl. No. 17/930,592; dated Dec. 22, 2023 (27 pages).

(Continued)

*Primary Examiner* — Edwin J Toledo-Duran

(74) *Attorney, Agent, or Firm* — Osha Bergman Watanabe & Burton LLP

(57) ABSTRACT

A method includes providing a well extending underground from a surface, using radial drilling to drill a primary tunnel extending in an outwardly direction from the well at a first axial location along the well, installing a chemical storage assembly in the primary tunnel, and ejecting chemicals from the chemical storage assembly into the well.

18 Claims, 7 Drawing Sheets

(56) References Cited

U.S. PATENT DOCUMENTS

| | | | | |
|---|---|---|---|---|
| 6,279,658 | B1 * | 8/2001 | Donovan | E21B 43/38 166/266 |
| 6,318,457 | B1 * | 11/2001 | Den Boer | E21B 43/305 166/207 |
| 6,380,476 | B1 * | 4/2002 | Heijnen | E21B 41/0085 166/65.1 |
| 6,488,087 | B2 * | 12/2002 | Longbottom | E21B 41/0035 166/50 |
| 6,951,252 | B2 * | 10/2005 | Restarick | E21B 41/0035 166/117.6 |
| 6,964,308 | B1 * | 11/2005 | Zupanick | E21B 7/067 175/62 |
| 6,981,553 | B2 | 1/2006 | Stegemeier et al. | |
| 6,991,047 | B2 * | 1/2006 | Zupanick | E21B 41/0042 166/117.6 |
| 7,090,009 | B2 * | 8/2006 | Zupanick | E21B 43/305 166/50 |
| 7,637,316 | B2 * | 12/2009 | Best | E21B 43/305 166/50 |
| 7,878,249 | B2 * | 2/2011 | Lovell | E21B 47/125 166/313 |
| 8,127,833 | B2 | 3/2012 | Pabon et al. | |
| 10,487,647 | B2 | 11/2019 | Song et al. | |
| 2001/0045280 | A1 * | 11/2001 | Longbottom | E21B 43/305 166/285 |
| 2003/0048697 | A1 | 3/2003 | Hirsch et al. | |
| 2004/0016549 | A1 * | 1/2004 | Selinger | E21B 43/006 166/305.1 |
| 2004/0043501 | A1 | 3/2004 | Means et al. | |
| 2005/0012340 | A1 | 1/2005 | Cousins | |
| 2009/0080291 | A1 * | 3/2009 | Tubel | E21B 41/0035 73/152.01 |
| 2009/0151950 | A1 * | 6/2009 | Patel | E21B 41/0035 166/244.1 |
| 2009/0277629 | A1 | 11/2009 | Mendez et al. | |
| 2012/0067567 | A1 * | 3/2012 | Rytlewski | E21B 41/0085 166/250.01 |
| 2012/0305241 | A1 | 12/2012 | Rytlewski et al. | |
| 2015/0027507 | A1 | 1/2015 | Noui-Mehidi | |
| 2016/0069173 | A1 | 3/2016 | Castro et al. | |
| 2017/0107805 | A1 * | 4/2017 | Dallas | E21B 43/305 |
| 2017/0130542 | A1 | 5/2017 | Savage | |
| 2019/0353011 | A1 | 11/2019 | Ross et al. | |
| 2020/0003033 | A1 * | 1/2020 | Dusterhoft | E21B 33/14 |
| 2020/0095847 | A1 | 3/2020 | Signorelli et al. | |
| 2021/0025241 | A1 | 1/2021 | Crichlow | |
| 2022/0178211 | A1 * | 6/2022 | Steele | E21B 47/12 |
| 2024/0280002 | A1 * | 8/2024 | El Mallawany | E21B 41/0085 |

OTHER PUBLICATIONS

International Search Report issued in corresponding International Application No. PCT/US2023/032166; mailed Dec. 13, 2023 (5 pages).

Written Opinion of the International Searching Authority issued in corresponding International Application No. PCT/US2023/032166; dated Dec. 13, 2023 (8 pages).

Noui-Mehidi, Mohamed Nabil and Ahmed Rizq, "Downhole Energy Harvesting From an Isothermal Well Zone by Converting a Differential Pressure into a Differential Temperature and Combining Thermo-Generators for Smart Well Completions", SPE-198145-MS, Society of Petroleum Engineers, Oct. 2019, pp. 1-8 (8 pages).

"Downhole Batteries for MWD and LWD Applications", MWD/LWD Downhole Batteries—Excel Battery Co., Access Date: Sep. 7, 2022, URL: <https://excellbattery.com/products/downhole-batteries/> (2 pages).

Hamlehdar, Maryam, et al., "Energy Harvesting from Fluid Flow using Piezoelectrics: A Critical Review", Renewable Energy: An International Journal, doi:10.1016/j.renene.2019.05.078, 2019 (43 pages).

Jones, Willie, "Waste Heat to Electricity Breakthrough: Northwestern University boosts material's ability to transform heat into current by refining it on three size scales", IEEE, Sep. 19, 2012, URL: <https://spectrum.ieee.org/semiconductors/materials/waste-heat-to-electricity-breakthrough> (5 pages).

* cited by examiner

METHOD FOR DOWNHOLE CHEMICAL STORAGE FOR WELL MITIGATION AND RESERVOIR TREATMENTS

BACKGROUND

Wells are drilled into subsurface formations to produce valuable resources, such as oil and gas. A well is typically drilled by moving a rotating drill bit attached at an end of a drill string through the earth to form a wellbore. The drill string and attached drill bit may be rotated and extended underground using rig equipment at the surface of the well. Drilling fluid, also referred to as "drilling mud" or simply "mud," is used to facilitate drilling wellbores into the earth. As the drill string and bit are rotated to drill the wellbore, one or more mud pumps at the surface of the well circulates drilling fluid through the well, where the drilling fluid may flow from the surface of the well, through the drill string, out the end of the drill string, and back up the well through an annulus formed around the outside of the drill string to return to the surface of the well. As the wellbore is formed, strings of casing and/or liner may be installed to line the wellbore wall. Casing may be installed in the well by pumping cement into an annulus formed between the casing string and the wellbore wall. Wells may be drilled to extend vertically, horizontally, or other direction through the earth.

Radial drilling refers to a method of drilling small generally radially extending tunnels (typically a few inches in diameter) extending from a main well into the formation strata (typically to a maximum of about 300-400 feet). Radial drilling is commonly used to access trapped oil or gas in the near-well formation and stimulate production. Radial drilling tools are often deployed through the main well using coiled tubing, although slickline has also been used. Unlike drill string, which is made of multiple rigid sections of pipe that are threaded together in an end-to-end fashion, coiled tubing is a long, continuous length of pipe that is wound on a spool to be stored or transported and then straightened to be pushed into a well.

Radial drilling may include radial jet drilling, where a high-pressure fluid is jetted through radial drilling tools to penetrate and form the tunnel, or mechanical radial drilling, where a radial drilling bit (rotated by a downhole mud motor) may be used to drill the tunnel. When radially drilling from a cased well, radial drilling may include a combination of milling through the casing with a radial drilling bit and jetting the tunnel from the milled hole in the casing.

Radial drilling tools may vary depending on the radial drilling technique being used and may include, for example, a downhole mud motor, a jetting nozzle and hose, a milling bit, and others. For example, a typical radial drilling system 100 is shown in FIG. 1, which may be used to drill a tunnel 101 extending radially from a cased main well 102 through a formation 103. A whipstock 104 (also referred to as a deflector shoe) may be lowered into the main well 102 via a tubing 105. One or more centralizers 109 may be positioned around the tubing 105 to keep the whipstock 104 centered within the tubing 105. Coiled tubing 106 having radial drilling equipment attached at the end may be extended through the tubing 105. The radial drilling equipment may include a downhole mud motor 107 and a radial drilling bit 108 rotatable by the mud motor 107 via a flexible pipe 110. As the mud motor 107 rotates the radial drilling bit 108, the radial drilling bit 108 may be directed through the whipstock 104 at a turn 111 ("heel") to contact and cut through the main well casing into the formation 103 around the main well 102. In radial jet drilling operations, the radial drilling bit 108 may be removed after initiating the tunnel 101 from the main well 102, and a high-pressure nozzle and hose may be extended through the whipstock 104 to eject a high-pressure fluid to hydraulically impact and extend the tunnel 101 into the formation 103.

Radial drilling is different from coiled-tubing sidetracking procedures and conventional horizontal drilling, which may be used to drill branch wellbores, e.g., for multilateral wells. A multilateral well is a well with two or more branch wells drill from a main well that may allow one well to produce from several reservoirs via the branch wells (rather than drilling multiple separate wells from the surface to the different reservoir areas). A major difference between radial drilling and conventional sidetracking or horizontal drilling is that radial drilling generally operates at a much smaller scale, e.g., 2 to 4 orders of magnitude smaller than conventional sidetracking and horizontal drilling. For example, branch wellbores (sometimes referred to as laterals) may be drilled at an angle from the main well around a heel that is typically hundreds or thousands of feet in length. In contrast, radial drilling typically involves a change of direction with a tighter radius of curvature that occurs entirely around a whipstock, e.g., with a heel ranging from a few inches to a few meters. For example, radial drilling techniques may produce tunnels extending from a main well at an angle of 90 degrees or less. Due to the small radius of curvature from radially drilled tunnels, longer conventional drilling tools used in drilling branch wells would not be able to fit in radially drilled tunnels.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to methods that include providing a well extending underground from a surface, using radial drilling to drill a primary tunnel extending in an outwardly direction from the well at a first axial location along the well, installing a chemical storage assembly in the primary tunnel, and ejecting the chemicals from the chemical storage assembly into the well.

In another aspect, embodiments disclosed herein relate to methods that include providing a well extending underground from a surface, drilling a primary tunnel extending a length from the well in an outwardly direction from the well, and installing a chemical storage assembly in the primary tunnel. After installation, a downhole tool may be moved through the well and past the primary tunnel to perform a well operation. Chemicals may be ejected from the chemical storage assembly during or after performing the well operation.

In yet another aspect, embodiments disclosed herein relate to systems that include a well extending through an underground formation, a primary tunnel extending a length outwardly from the well at a first axial location along the well, a chemical storage assembly installed in the primary tunnel, a secondary tunnel extending outwardly from the well, and a power source installed in the secondary tunnel, wherein the power source is connected to the chemical storage assembly.

Other aspects and advantages will be apparent from the following description and the appended claims.

BRIEF DESCRIPTION OF DRAWINGS

Wherever possible, like or identical reference numerals are used in the figures to identify common or the same elements. The figures are not necessarily to scale and certain features and certain views of the figures may be shown exaggerated in scale for purposes of clarification.

DETAILED DESCRIPTION

Embodiments of the present disclosure are described below in detail with reference to the accompanying figures. In the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Embodiments disclosed herein relate generally to systems and methods for storing chemicals downhole in one or more small tunnels (or ratholes) formed off a well. The chemicals may be stored in a chemical storage assembly that is capable of releasing the stored chemicals into the well, e.g., for well mitigation, well maintenance, damage prevention, reservoir treatments, or other downhole operations utilizing chemical additives. The tunnels used for holding chemical storage assemblies may be drilled using reservoir tunneling techniques, such as radial drilling. By using systems and methods according to embodiments of the present disclosure to store chemicals in a tunnel off a well, well operations may be performed without having the stored chemicals interfere. For example, conventional downhole completion operations have limited access and small space for device installations in the well being produced. By providing a chemical storage assembly in a tunnel off the well according to embodiments of the present disclosure, one or more downhole completion operations may be performed in the well (which may or may not include using chemicals stored in the chemical storage assembly) without interference from the chemical storage assembly and without removing production equipment for a separate chemical injection operation.

Figure 2:
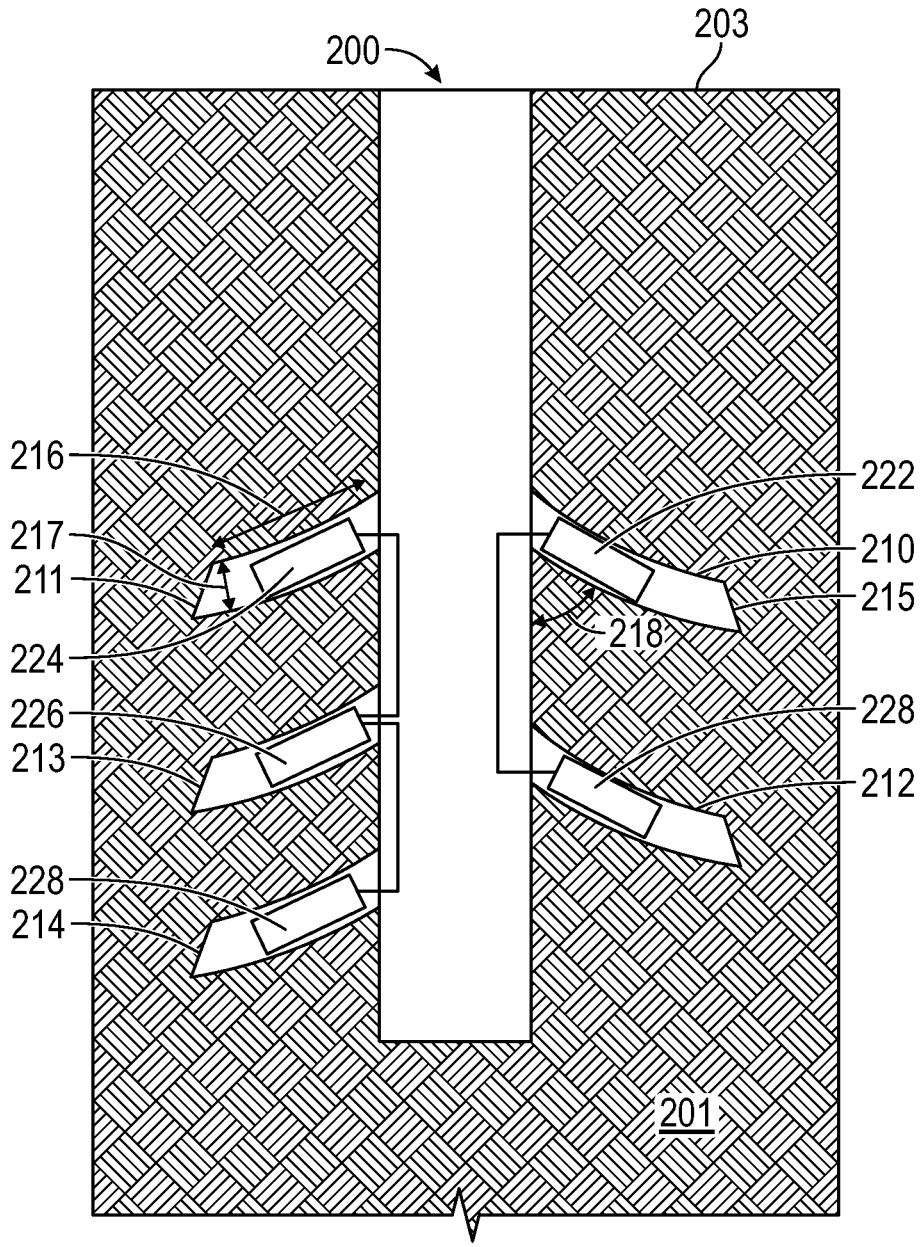
FIG. 2 shows an example of a chemical storage system in a well according to embodiments of the present disclosure.

FIG. 2 shows an example of a system according to embodiments of the present disclosure. As shown, a chemical storage system according to embodiments of the present disclosure may be provided along a well 200 extending through an underground formation 201. The well 200 may be drilled using conventional well drilling techniques and may be cased or uncased. For example, a drill bit attached at an end of a drill string may be rotated and moved through the formation 201 to drill a wellbore wall as drilling fluid is circulated through the well. After a wellbore is drilled, a length of the wellbore may be cased or remain uncased, where casing includes lowering a casing string into the wellbore and pumping cement between the annulus formed between the wellbore wall and the casing string. However, other drilling and casing/lining techniques known in the art may be used to form a well 200.

The chemical storage system may include one or more tunnels 215 extending outwardly from the well 200 at different axial and/or circumferential locations around the well 200. In the example shown in FIG. 2, the system includes multiple tunnels 215 located at different locations around the well 200, including a primary tunnel 210 located at a first axial location along the well 200, an additional primary tunnel 211 located at the first axial location and at a different circumferential position around the well 200 from the primary tunnel 210, a secondary tunnel 212 located at a second axial location along the well 200, a tertiary tunnel 213 located at a third axial location along the well 200, and a quaternary tunnel 214 located at a fourth axial location along the well 200. The amount and locations of tunnels 215 extending from a well 200 may vary based on, for example, the chemical storage assembly being used, and the amount of chemicals being stored.

The tunnels 215 may be formed using tunneling techniques known in the art, such as radial jet drilling or mechanical radial drilling. In some embodiments, a radial drilling tool may be deployed using coiled tubing, where the radial drilling tool may include a radial drilling bit attached at an end of a flexible line. The coiled tubing may be used to direct the radial drilling tool through a whipstock to radially drill a small tunnel extending outwardly from a well. The coiled tubing may be large diameter (e.g., 2 inches or more) coiled tubing, which generally has high axial and torsional stiffness, or small diameter (e.g., % inch) coiled tubing, which has limited axial stiffness and low resistance to torque. The coiled tubing may act as both the retrieval line for the radial drilling tool and the power supply line for the radial drilling tool. In some embodiments, a tunnel may be formed using sidetrack drilling, which is a technique conventionally used to drill a new branch wellbore from an existing well that has poor or no productivity. When using sidetrack drilling techniques, instead of drilling a new wellbore to increase production through the new wellbore, the sidetrack drilling may be used to drill a relatively shorter distance to a "dead-end," where the formed tunnel may be long enough to store components described herein, but not long enough to reach additional production locations.

Tunnels 215 drilled off a well 200 may be distinguished from a typical well (e.g., a main well extending from a surface to an underground formation or a branch well extending from a main well to another formation) in that the tunnels 215 may be limited in size and location so as not to reach a producing reservoir. In other words, a tunnel 215 may be drilled within a non-producing area off the well, such that fluids do not flow from the surrounding formation through the tunnel 215 and into the well 200. Additionally, or alternatively, tunnels 215 may be distinguished from a typical well in size, where tunnels 215 may be much smaller than the well 200. For example, tunnels 215 may have a size small enough to where conventional well tools would not fit.

According to embodiments of the present disclosure, tunnels 215 may extend a length 216 outwardly from the well 200 and may have a diameter 217. The length 216 and diameter 217 of a tunnel 215 may vary depending on, for example, the tunneling technique used to form the tunnel and the component being stored in the tunnel. According to embodiments of the present disclosure, the length 216 of a tunnel 215 may range, for example, between 3 feet to 300 feet. In some embodiments, the length 216 of a tunnel 215 may be less than 200 feet (e.g., less than 100 feet). The diameter 217 of a tunnel 215 may range, for example, between 1 inch and 6 inches. In some embodiments, tunnels 215 may be formed having diameters that are less than 4 inches. In some embodiments, tunnels 215 may be designed to have a smaller diameter than the diameter of the well 200 from which it extends. For example, well 200 diameters may range from about 9 inches to 3 inches, while tunnels 215 may have a diameter ranging from about 7 inches to less than 1 inch. In some embodiments, tunnels 215 may be as small as 0.5 inches in diameter extending from a well with a 3-inch diameter casing.

Additionally, tunnels 215 may extend outwardly from a well 200 at an axial angle 218 measured between the wall of the well 200 and the wall of the tunnel 215 adjacent to the opening of the tunnel 215, where the axial angle 218 may range, for example, from about 45 degrees to about 90 degrees. The axial angle 218 may depend on the tunneling technique. For example, sidetrack drilling may have a "dog-leg" severity of less than 45 degrees/100 ft of course length.

Chemical storage assemblies 220 according to embodiments of the present disclosure may be designed to fit within tunnels 215 drilled off a well 200. According to embodiments of the present disclosure, a chemical storage assembly 220 may include a compartment in which chemicals may be stored and dispensed. For example, a chemical storage assembly 220 may include a chemical storage compartment (e.g., a container) containing chemicals and a dispensing mechanism (e.g., a pump) in fluid communication with the chemical storage compartment, where the dispensing mechanism may be used to dispense chemicals from the compartment. In some embodiments, one or more additional chemical storage compartments may be in fluid communication with a dispensing mechanism, such that a single dispensing mechanism may dispense chemicals from multiple chemical storage compartments. In some embodiments, a chemical storage compartment may be a pill capsule containing the chemicals, where the pill capsule may be dissolved under certain downhole environmental conditions to dispense the chemicals. Various configurations of a chemical storage compartment and dispensing mechanism working in conjunction to store and dispense chemicals may be used to form chemical storage assemblies 220 that fit within tunnels 215.

For example, as shown in FIG. 2, chemical storage assemblies 220 may be designed as a single tool 222 having a chemical storage compartment and integrated dispensing mechanism, or as a multi-component assembly including a chemical storage compartment 224 that is separate from but in fluid communication with a dispensing mechanism 226. Additionally, in some embodiments, chemical storage assemblies 220 may have one or more components (e.g., a pump or controller) powered by a power source 228 (e.g., a battery). Different components of a chemical storage assembly may be installed into different tunnels 215.

Figure 3:
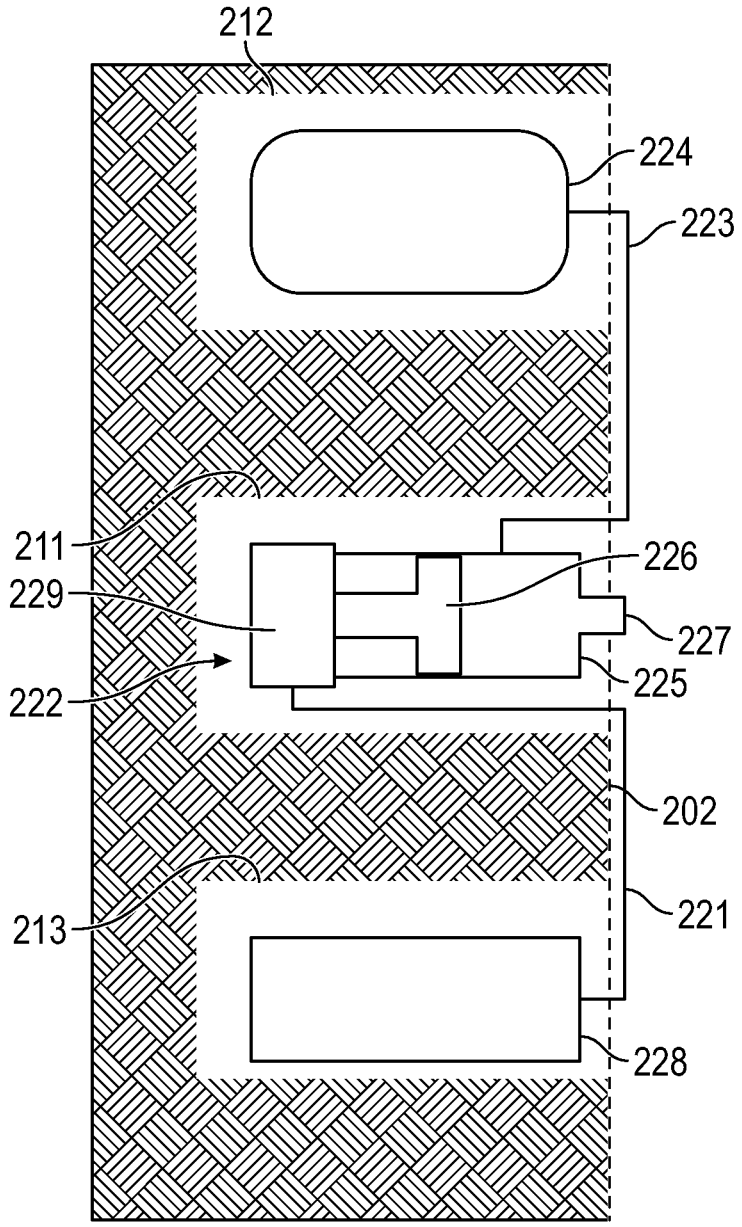
FIG. 3 shows an example of a chemical storage assembly according to embodiments of the present disclosure.
Figure 4:
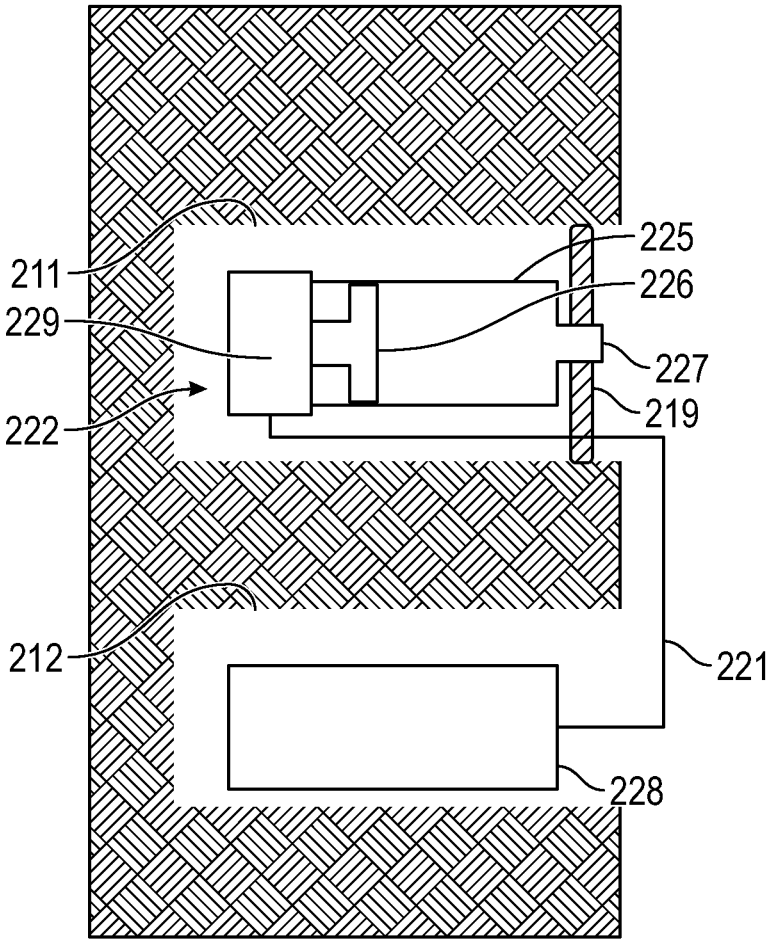
FIG. 4 shows an example of a chemical storage assembly according to embodiments of the present disclosure.
Figure 5:
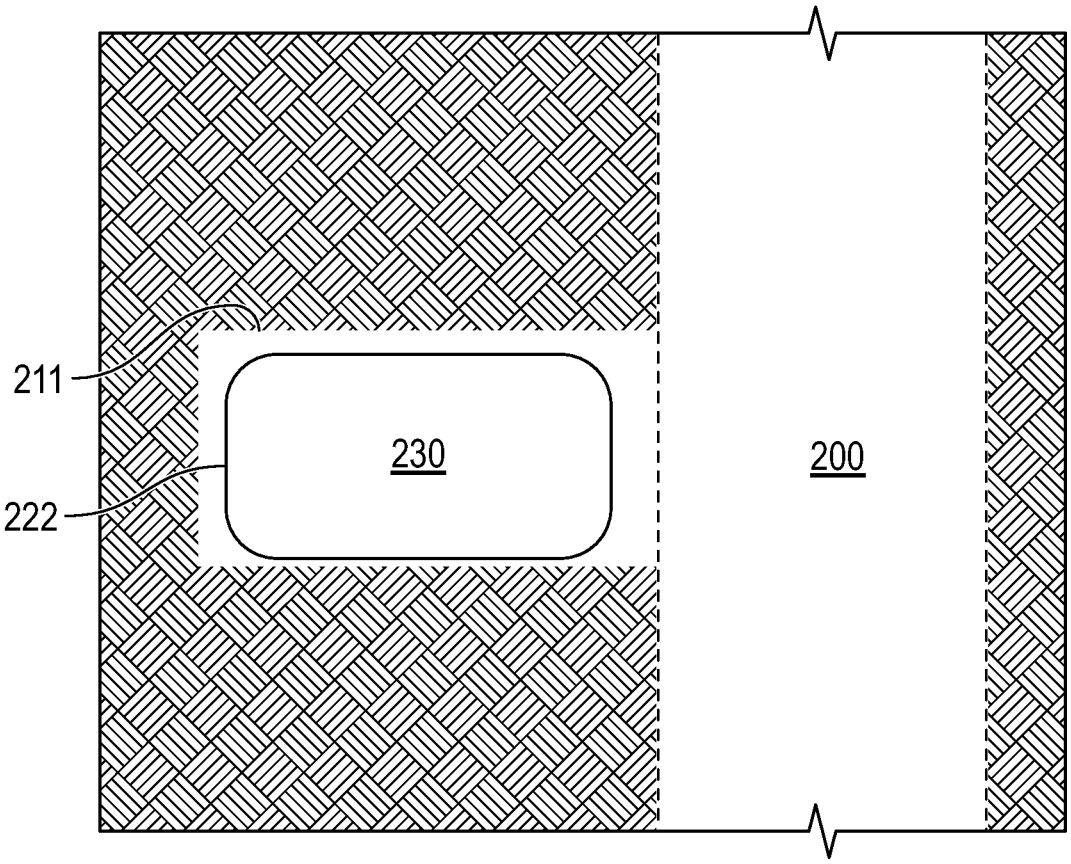
FIG. 5 shows an example of a chemical storage assembly according to embodiments of the present disclosure.

FIGS. 3-5 show a small number of examples of chemical storage assemblies 220 that may be used in systems according to embodiments of the present disclosure. However, there are numerous other configurations of chemical storage assemblies according to embodiments of the present disclosure that may be used. The configuration and amount of chemical storage compartments used in a chemical storage assembly 220 according to embodiments of the present disclosure may be designed or selected, for example, based on the amount of chemicals needing to be stored.

Referring to FIG. 3, a chemical storage assembly 220 may include multiple components stored in separate tunnels 215. For example, a chemical storage assembly 220 may include a tool 222 stored in a primary tunnel 211 located at a first axial location along a well 200, an additional chemical storage compartment 224 stored in a secondary tunnel 212 located at a second axial location along the well 200, and a power source 228 stored in a tertiary tunnel 213 located at a third axial location along the well 200.

The tool 222 may have a dispensing mechanism 226 integrated with a chemical storage compartment 225. The dispensing mechanism 226 may be a plunger-type pump, or other type of pump, which may apply pressure on chemicals (e.g., fluid chemicals or chemicals provided in a solution) in the chemical storage compartment 225. The pump may be activated to pump chemicals out of the chemical storage compartment 225 through an opening 227 (e.g., a spray nozzle or valved opening). The dispensing mechanism 226 may be operated via a controller 229, which may be powered by a power source 228. For example, a dispensing mechanism 226 (such as a pump) may be programmed via the controller 229 to dispense (e.g., pump) a controlled dosage of the chemicals from the chemical storage compartment 225. In some embodiments, chemicals may be compressed within a chemical storage compartment 225 (e.g., as a compressed fluid), and the dispensing mechanism 226 may be a valved opening that may selectively let out an amount of the compressed chemicals. In such embodiments, a power source 228 may be used to power operation of the valved opening. Although specific examples of a tool 222 having an integrated dispensing mechanism 226 and chemical storage compartment 225 are discussed herein, other configurations of the tool 222 may be envisioned to provide a device that is capable of ejecting stored chemicals.

According to embodiments of the present disclosure, dispensing mechanisms 226 may be powered by a power source 228, which may be provided in a separate tunnel (e.g., as shown in FIG. 3) or may be integrally provided with the tool 222. For example, as shown in FIG. 3, the power source 228 (e.g., a rechargeable battery) may be electrically connected to a controller 229 for the dispensing mechanism 226, such that the power source 228 may power operation of the dispensing mechanism 226. One or more electrical cables 221 may be used to electrically connect the power source 228 and the tool 222. Electrical cables 221 may extend from the power source 228 in one tunnel 213 and along a wall 202 of the well to a different tunnel 211 holding the tool 222. Because tunnels 215 (e.g., formed by mechanical radial drilling) may be limited in size, providing a power source 228 in a separate tunnel from the tool 222 may allow for use of larger chemical storage compartments and/or larger power sources. In some embodiments, a power source may located overhead the chemical storage assembly, where power cables may be run through the well to connect the chemical storage assembly to a power source located at a surface of the well.

Additionally, in some embodiments, one or more additional chemical storage compartments 224 may be fluidly connected to the chemical storage compartment 225 in the tool 222. Additional chemical storage compartments 224 may be useful when large volumes of chemicals need to be stored that would otherwise not fit within a single tunnel (e.g., due to the size limitations of tunneling techniques). Additional chemical storage compartment(s) 224 may be fluidly connected to the tool 222 via one or more conduits 223. A conduit 223 may extend from an additional chemical storage compartment 224 in one tunnel 212 and along the wall 202 of the well to a different tunnel 211 holding the tool 222. In some embodiments, activation of the dispensing mechanism 226 in the tool 222 (e.g., a pump) may suction fluid chemicals from the additional chemical storage compartment 224 into the tool 222. However, other mechanisms may be used to direct fluid chemicals from the additional chemical storage compartment 224 to the tool 222 to be ejected into the well.

Referring now to FIG. 4, FIG. 4 shows another example of a chemical storage assembly according to embodiments of the present disclosure. The chemical storage assembly may include a tool 222 provided in a primary tunnel 211 extending outwardly from a well 200, and a power source 228 provided in a separate secondary tunnel 212 extending outwardly from the well 200. The tool 222 may be a self-contained device storing chemicals in a chemical storage compartment 225 part of the tool, where an integrated dispensing mechanism 226 may eject the chemicals from the chemical storage compartment 225 out an outlet 227 and into the well 200. The tool 222 may be provided downhole without any additional chemical storage compartments. In such embodiments, once all or most of the chemicals are ejected from the chemical storage compartment 225 in the tool 222, the tool 222 may be removed from the primary tunnel 211 and refilled at the surface of the well 200.

The tool 222 may be connected to the power source 228 via one or more electrical cables 221, which may extend from the power source 228 in the secondary tunnel 212 to the tool 222 in the primary tunnel 211.

In some embodiments, a non-metallic seal 219 may be installed at an opening to the primary tunnel 211 to isolate the primary tunnel 211 and its contents from a downhole environment in the well 200. The non-metallic seal 219 may be made of a rubber or polymer material and may have a diameter substantially equal to the diameter of the primary tunnel opening. The non-metallic seal 219 may have an opening, where the opening 227 of the tool 222 may extend through the non-metallic seal 219 to eject chemicals stored in the tool 222 to the well 200. In other embodiments, a non-metallic seal may be provided that has a dissolvable portion or a burst disc that may dissolve or burst upon reaching certain downhole conditions (e.g., a downhole pressure, downhole temperature, and/or chemical composition of fluid flowing through the well). Different chemicals may be affected in different ways by longtime storage in downhole pressurized and heated environments. By using a non-metallic seal 219 to isolate the tunnel and its contents from the downhole environment, the stored chemicals may be protected from degradation or other effects of the downhole environment and/or may be stored extended periods of time. According to embodiments of the present disclosure, the non-metallic seal 219 may be removed (or dissolved or burst) in order to maintain or replace components in the tunnel 211.

Referring to FIG. 5, FIG. 5 shows another example of a chemical storage assembly according to embodiments of the present disclosure. The chemical storage assembly may include a pill capsule 222 containing chemicals 230. The pill capsule 222 may be held in a primary tunnel 211 extending outwardly from a well 200, and upon a triggering condition, the pill capsule 222 may dissolve to release the chemicals 230 being stored therein. For example, the pill capsule 222 may be dissolved under certain downhole environmental conditions, such as pH fluid conditions in the well 200 or downhole temperature conditions, to dispense the chemicals. In some embodiments, encapsulated chemicals in a pill capsule 222 may be held within the tunnel 211 using frictional forces. For example, an outer diameter of the pill capsule 222 may be equal to or slightly less than an inner diameter of the tunnel 211, such that the friction between the inner diameter of the tunnel 211 and the outer diameter of the pill capsule 222 holds the pill capsule 222 in the tunnel 211). In some embodiments, a pill capsule 222 may incorporate a design of the same mechanisms that hold a packer inside a wellbore (e.g., having an expandable outer diameter) in order to hold the pill capsule 222 within the tunnel 211. In some embodiments, a separate small packer may be used to hold the pill capsule 222 within the tunnel 211.

Examples of chemical storage systems have been shown as being used with a vertical well 200, such as shown in FIG. 2, extending from a surface 203 a depth into a formation 201. However, chemical storage systems disclosed herein may also be used with horizontal wells and other directional wells. Further, chemical storage systems may be assembled in a main well, extending from and opening at a surface 203, or in a branch well, extending from and opening to a main well.

Figure 6:
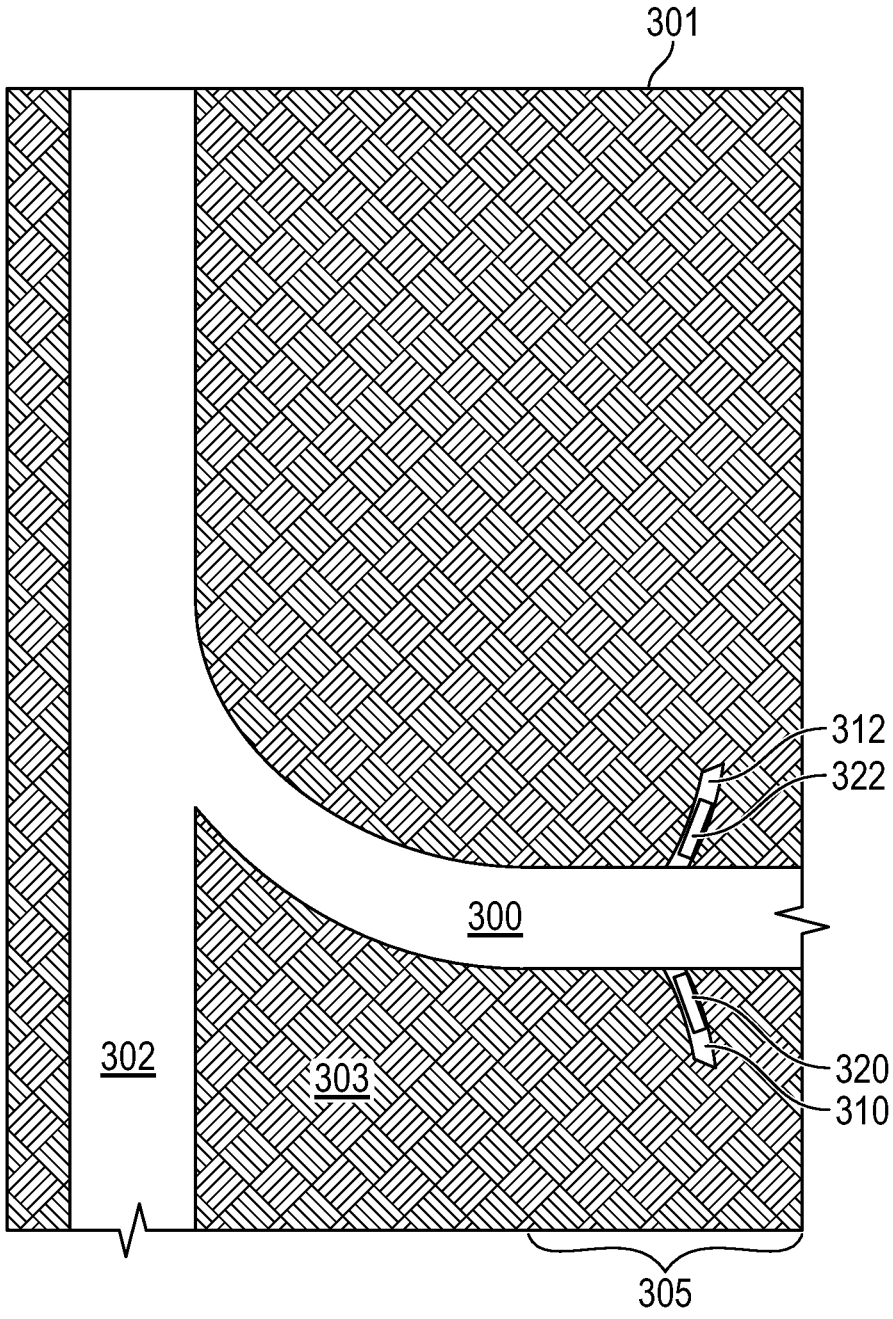
FIG. 6 shows an example of a chemical storage system in a well according to embodiments of the present disclosure.

For example, FIG. 6 shows an example of a chemical storage system installed in a horizontal portion 305 of a well 300. The well 300 may be a branch well that extends from a main well 302 to a reservoir formation, where the main well 302 may extend from a surface 301 through an underground formation 303. A first primary tunnel 310 may be drilled outwardly from the horizontal portion 305 of the well 300 at a first axial location along the well 300. A first chemical storage assembly 320 according to embodiments of the present disclosure may be positioned in the first primary tunnel 310. At least one additional primary tunnel 312 may be drilled at the first axial location and extend outwardly from the well 300 in a different direction from the first primary tunnel 312. At least one additional chemical storage assembly 322 according to embodiments of the present disclosure may be positioned in each of the additional primary tunnel(s) 312. When a chemical storage system includes multiple chemical storage assemblies 320, 322 assembled in downhole tunnels, the chemical storage assemblies 320, 322 may be of the same type and configuration or may be different types (e.g., different dispensing mechanisms) with different configurations (e.g., a different number of connected additional chemical storage compartments).

Figure 7:
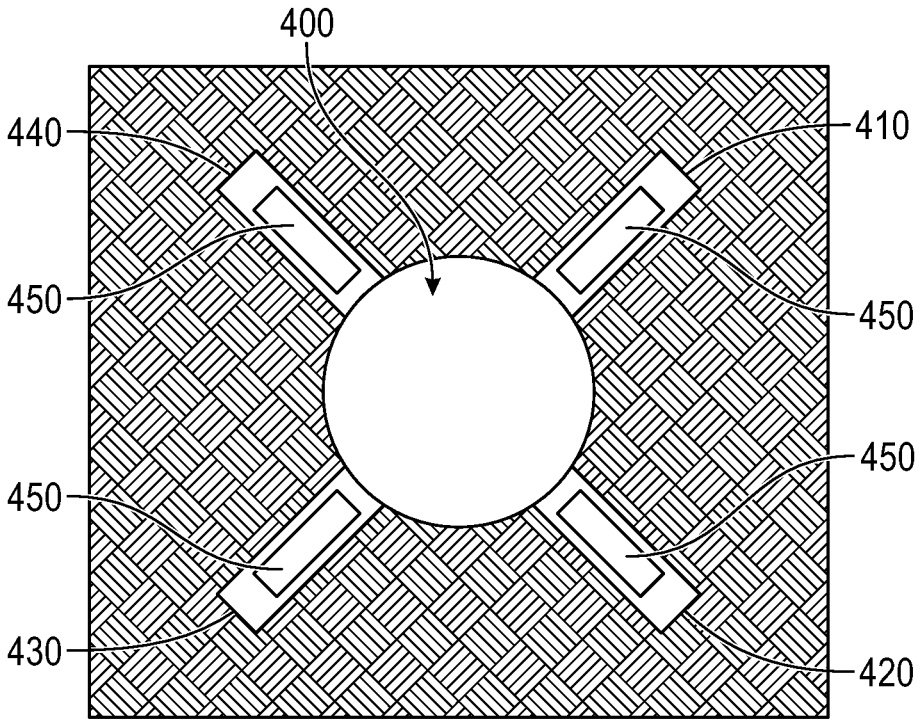
FIG. 7 shows an example of chemical storage assemblies stored in tunnels extending outwardly from a well according to embodiments of the present disclosure.

Additionally, one or more tunnels may be drilled at the same or different axial locations along a well. For example, FIG. 2 shows multiple tunnels 211, 213, 214 formed along different axial locations of a well 200 and multiple tunnels 211, 210 formed at the same axial location of the well 200. In some embodiments, more than two tunnels may be formed at the same axial location along a well. For example, FIG. 7 shows a cross-sectional view of a well 400 at an axial location along the well 400, where four tunnels 410, 420, 430, 440 extend outwardly from the well 400 in different directions at the same axial location along the well 400. Each tunnel 410, 420, 430, 440 may hold one or more components of a chemical storage assembly 450 according to embodiments of the present disclosure.

Figure 1:
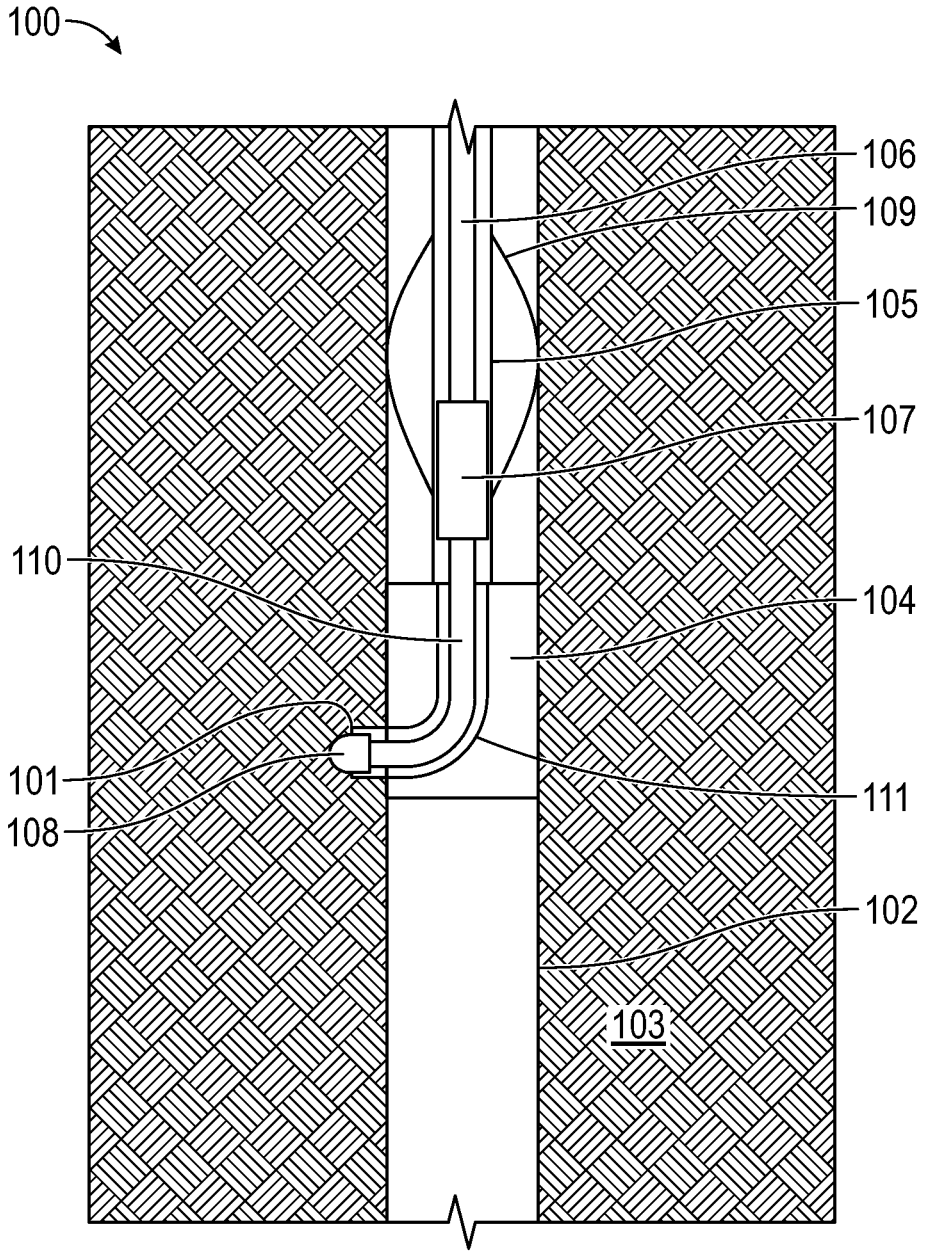
FIG. 1 (Prior Art)
FIG. 1 shows an example of a conventional radial drilling technique in a downhole well.

According to embodiments of the present disclosure, multiple tunnels may be drilled at a single axial location along a well using a simplified tunneling procedure including rotating the tunneling tool at the single axial location to drill the multiple tunnels. For example, in methods where tunnels are formed using mechanical radial drilling, a whipstock (e.g., 104 in FIG. 1) may be sent via a tubing (e.g., 105 in FIG. 1) to an axial location in a well and oriented in a first rotational position. A radial drilling bit (e.g., 108 in FIG. 1) may be directed through the whipstock to drill outwardly from the well into the surrounding formation in a first direction. After drilling a length into the formation to form a first tunnel, the radial drilling bit may be retracted and the whipstock may be rotated (e.g., a quarter turn) while remaining in the axial location to a second rotational position. The radial drilling bit may then be redirected through the whipstock to drill outwardly from the well into the formation in a second direction. After drilling a length into the formation to form a second tunnel, the radial drilling bit may be retracted and the whipstock may be rotated (e.g., a quarter turn) while remaining in the axial location to a third rotational position. The radial drilling bit may then be redirected through the whipstock to drill outwardly from the well into the formation in a third direction. Such rotation and drilling process may be repeated to form additional tunnels at the same axial location. Using such rotation and drilling process may allow for formation of multiple tunnels in a single location, without having to move and reposition a whipstock to different axial locations along the well.

After one or more tunnels are drilled off a well, chemical storage assemblies may be installed within the tunnel(s). According to embodiments of the present disclosure, the same tools used to drill the tunnel may also be used to land the chemical storage equipment inside the drilled tunnel (e.g., coiled tubing or drill string). For example, in some embodiments, one or more or all components of a chemical storage assembly may be installed within a tunnel using the same whipstock that was used to direct a radial drilling tool to drill the tunnel. In such embodiments, the component(s) of the chemical storage assembly may be directed through the whipstock and into the tunnel using a flexible running tool. The running tool may hold a chemical storage assembly in an orientation that when the running tool releases the chemical storage assembly, an opening to eject chemicals from the chemical storage assembly may face toward the well.

In some embodiments, a system may be designed to hold chemical storage assemblies within tunnels extending from a horizontal portion of a well such that the chemical storage assemblies are held in the tunnels even while fluids are being circulated through the well. For example, in some embodiments, when tunnels are drilled off a horizontal portion of a well, chemical storage assemblies may be held inside tunnels extending laterally or in a downward direction from the horizontal portion. In some embodiments, when tunnels are drilled off a horizontal portion of a well, chemical storage assemblies may be held inside tunnels extending from the horizontal portion of the well using gripping elements, such as a separate small packer installed around the chemical storage assembly to hold the chemical storage assembly within the tunnel.

In embodiments where a chemical storage assembly has multiple components installed in multiple tunnels, the components may be connected together before or after installing each component in their respective tunnels. For example, according to embodiments of the present disclosure, a chemical storage assembly having a chemical storage compartment and integrated dispensing mechanism may be installed in primary tunnel extending from a well at a first axial location along the well. A power source, such as a rechargeable battery, may be installed in a secondary tunnel extending from the well at a different, second axial location along the well. The power source in the secondary tunnel may then be connected to the chemical storage assembly in the primary tunnel. In some embodiments, a power source may be installed in a secondary tunnel extending from the well at the same, first axial location along the well as the primary tunnel, where the power source and the chemical storage assembly may be connected together at the first axial location along the well.

Figure 8:
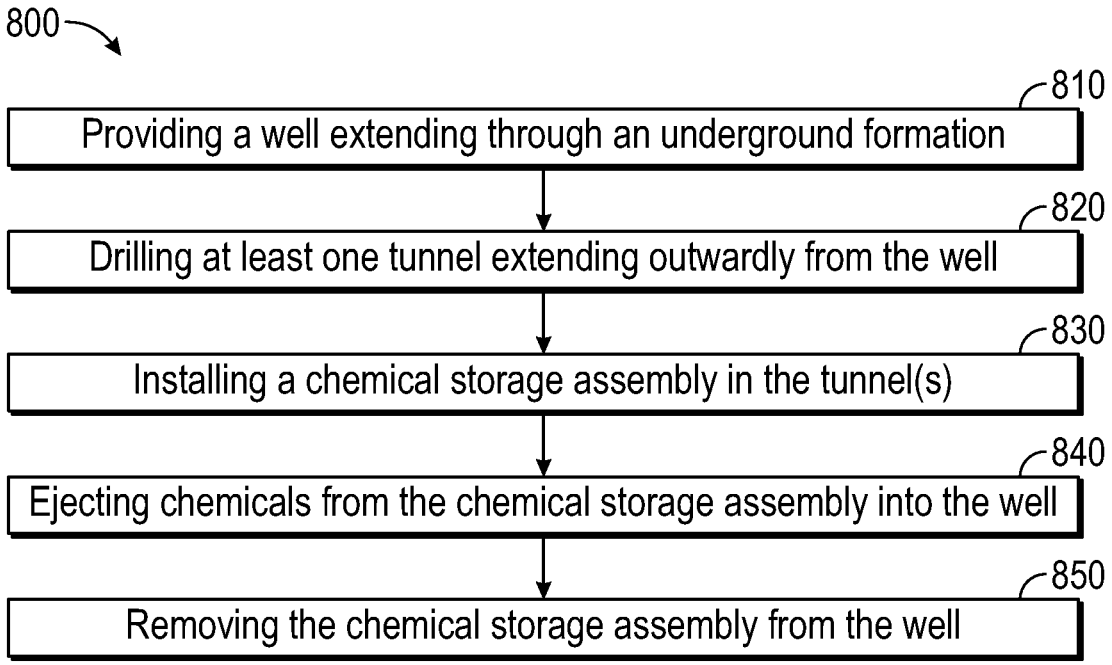
FIG. 8 shows an example of a method according to embodiments of the present disclosure.

Referring now to FIG. 8, FIG. 8 shows an example of a method 800 for assembling and using a chemical storage system according to embodiments of the present disclosure. One or more steps shown in the example may be repeated or omitted in various embodiments according to the present disclosure. Additionally, methods according to embodiments of the present disclosure may include additional steps, as described herein, that may not be shown in FIG. 8.

As shown, the method 800 may include providing a well extending through an underground formation (step 810) and drilling at least one tunnel extending outwardly from the well (step 820). A chemical storage assembly may be installed within the tunnel(s) (step 830), where the chemical storage assembly may include chemicals stored in at least one chemical storage compartment and a dispensing mechanism.

After a chemical storage system is set up in a well, chemicals may be ejected from a chemical storage assembly into the well (step 840). In some embodiments, chemicals may be ejected from an installed chemical storage assembly during or after performing a well operation. For example, a well operation may include a workover operation, such as a repair job or stimulation of an existing production well, a maintenance procedure performed on the well, a remedial treatment on the well, or an operation that includes the removal and/or replacement of a production string from the well (e.g., after the well has been killed and a workover rig has been placed at the well). Chemicals from one or more installed chemical storage assemblies may be ejected during or after performing the well operation, for example, where the ejected chemicals may be used for the well operation.

In some embodiments, a well operation may include moving a downhole tool (e.g., a production string) through the well and past the chemical storage assembly and tunnel to perform a well operation. By providing chemical storage assemblies in tunnels formed off the well, downhole tools may be passed through the well and past the assemblies without interference from the chemical storage assemblies.

According to embodiments of the present disclosure, after chemicals are ejected from a chemical storage assembly, the chemical storage assembly may be pulled out of the tunnel to remove the chemical storage assembly from the well (step 850). In some embodiments, brine may be circulated through the well as the chemical storage assembly is removed. Chemical storage assemblies may be removed from a well, for example, using a running tool.

Methods and systems described herein may be used in vertical well sections, horizontal well sections, and other directional well sections for various applications. Examples of applications in which methods and system described herein may be used include, but are not limited to, the following:

1) providing downhole chemicals for protections of downhole expensive completion equipment and tools;
2) $H_2S$ mitigation using various $H_2S$ scavenging chemicals including but not limited to methylene bis-oxazolidine (MBO), ethylenedioxy dimethanol (EDDM), 2-ethyl zinc salt, glyoxal, hemiacetal and monoethanolamine (MEA) triazine;

3) $H_2S$ adsorption using $H_2S$ adsorption chemicals stored in the tunnels to adsorb $H_2S$ after reservoir acid treatment to protect downhole equipment; using scale inhibitors as the chemicals, including inorganic phosphate, organophosphorous and organic polymer backbones such as PBTC (phosphonobutane-1,2,4-tricarboxylic acid), ATMP (amino-trimethylene phosphonic acid) and HEDP (1-hydroxyethylidene-1,1-diphosphonic acid), polyacrylic acid (PAA), phosphinopolyacrylates (such as phosphino polycarboxylic acid (PPCA)), polymaleic acids (e.g., para-methoxyamphetamine (PMA)), maleic acid terpolymers (MAT), sulfonic acid copolymers, such as SPOCA (sulfonated phosphonocarboxylic acid), polyvinyl sulfonates, poly-phosphono carboxylic acid (PPCA) and diethylenetriamine-penta (methylene phosphonic acid) DTPMP;

4) corrosion mitigation, where corrosion inhibitors may be used as the stored chemicals, including compounds of quaternary amines, amides, imidazolines, phosphate esters;

5) using encapsulated inhibitors and other chemicals for chemical treatments;

6) storing surfactants in chemical storage assemblies;

7) condensate removal;

8) fluid lifting;

9) scale inhibition for sandstone reservoir; and 10) other reservoir treatments.

By using methods and systems described herein, numerous types of chemicals may be stored downhole and used, as desired, for various well applications. By storing chemicals in tunnels off a well, well operations may be conducted without interference from the chemical storage assemblies and without intermittent shutdown times to conduct separate chemical injection operations.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method, comprising:

providing a well extending underground from a surface;

using radial drilling to drill a primary tunnel extending in an outwardly direction from the well at a first axial location along the well;

drilling a secondary tunnel extending from the well to a second axial location along the main well, wherein the primary tunnel and the secondary tunnel are drilled within a non-producing area off the well;

installing a power source in the secondary tunnel;

installing a chemical storage assembly in the primary tunnel, wherein the chemical storage assembly comprises chemicals stored in the chemical storage assembly;

connecting the power source to the chemical storage assembly in the primary tunnel;

powering the chemical storage assembly via the power source; and ejecting the chemicals from the chemical storage assembly into the well.

2. The method of claim 1, wherein the chemical storage assembly further comprises a pill capsule containing the chemicals, wherein the pill capsule comprises a dissolvable casing.

3. The method of claim 1, wherein the ejecting of the chemicals is triggered by a change in a downhole environmental condition, wherein the downhole environmental condition comprises a downhole temperature condition.

4. The method of claim 1, further comprising:

pulling the chemical storage assembly out of the primary tunnel after ejecting the chemicals to remove the chemical storage assembly; and circulating brine through the well as the chemical storage assembly is removed.

5. The method of claim 1, wherein the radial drilling comprises using a whipstock to orient a radial drilling bit in the outwardly direction from the well as the radial drilling bit drills the primary tunnel, wherein the method further comprises:

rotating the whipstock in the well to orient the radial drilling bit in a second outwardly direction from the well; and drilling an additional primary tunnel in the second outwardly direction from the well at the first axial location.

6. The method of claim 1, further comprising installing a non-metallic seal at an opening to the primary tunnel to isolate the primary tunnel from a downhole environment in the well.

7. A method, comprising:

providing a well extending underground from a surface;

drilling different tunnels off the well, comprising:

drilling a primary tunnel extending a length from the well in an outwardly direction from the well;

drilling a secondary tunnel extending outwardly from the well at a different location than the primary tunnel, wherein each of the tunnels are drilled within a non-producing area off the well;

installing different components of a chemical storage assembly in the different tunnels the installing comprising:

installing a first component of the components in the primary tunnel, wherein the first component is a dispensing mechanism;

installing a second component of the components in the secondary tunnel, wherein the second component is a chemical storage compartment;

installing a third component of the components in a third tunnel, wherein the third component is a power source;

fluidly connecting the chemical storage compartment to the dispensing mechanism;

powering the chemical storage assembly via the power source;

moving a downhole tool through the well and past the primary tunnel to perform a well operation; and ejecting chemicals from the chemical storage assembly into the well via the dispensing mechanism during or after performing the well operation.

8. The method of claim 7, wherein the well operation is a workover operation comprising extending a production string through the main well.

9. The method of claim 7, wherein the length of the primary tunnel is less than 300 feet.

10. The method of claim 7, further comprising:

wherein the dispensing mechanism is operated by a controller;

connecting the power source to the controller via one or more electrical cables; and using the controller to eject controlled dosages of the chemicals from the chemical storage assembly via the dispensing mechanism.

11. A system, comprising:

a well extending through an underground formation;

multiple tunnels extending from the well at different locations, the multiple tunnels comprising:

a primary tunnel extending a length outwardly from the well at a first axial location along the well; and a secondary tunnel extending outwardly from the well at a second axial location along the well, wherein each of the multiple tunnels is drilled within a non-producing area off the well; and a chemical storage assembly comprising multiple components, wherein at least two of the multiple components are installed in different tunnels of the multiple tunnels, comprising:

a first component of the chemical storage assembly installed in the primary tunnel, wherein the chemical storage assembly comprises chemicals stored in the chemical storage assembly, the chemicals configured to be ejected into the well; and a power source of the chemical storage assembly installed in the secondary tunnel, wherein the first component is fluidly connected to the power source and powered by the power source.

12. The system of claim 11, wherein the well is a branch well extending from a main well, and the main well extends underground from a surface.

13. The system of claim 11, wherein the multiple components of the chemical storage assembly further comprise:

a chemical storage compartment containing the chemicals; and a pump in fluid communication with the chemical storage compartment.

14. The system of claim 13, wherein the pump is programmed to pump a controlled dosage of the chemicals.

15. The system of claim 11, further comprising an additional primary tunnel at the first axial location extending outwardly from the well in a different direction from the primary tunnel.

16. The system of claim 11, further comprising:

an additional tunnel extending outwardly from the well; and a chemical storage compartment disposed in the additional tunnel, wherein the chemical storage compartment is fluidly connected to the first component in the primary tunnel.

17. The system of claim 11, wherein the primary tunnel and the secondary tunnel have diameters that are less than 7 inches.

18. The system of claim 11, wherein the primary tunnel and the secondary tunnel extend outwardly from a horizontal section of the main well.

* * * * *